US012195690B2

(12) United States Patent
Filippini et al.

(10) Patent No.: US 12,195,690 B2
(45) Date of Patent: Jan. 14, 2025

(54) METHOD OF LUBRICATING AN AUTOMOTIVE OR INDUSTRIAL GEAR

(71) Applicant: The Lubrizol Corporation, Wickliffe, OH (US)

(72) Inventors: Brian B. Filippini, University Heights, OH (US); William R. S. Barton, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 17/921,199

(22) PCT Filed: Apr. 19, 2021

(86) PCT No.: PCT/US2021/027869

§ 371 (c)(1),
(2) Date: Oct. 25, 2022

(87) PCT Pub. No.: WO2021/221936

PCT Pub. Date: Nov. 4, 2021

(65) Prior Publication Data

US 2023/0174886 A1 Jun. 8, 2023

Related U.S. Application Data

(60) Provisional application No. 63/015,884, filed on Apr. 27, 2020.

(51) Int. Cl.

| | |
|---|---|
| ***C10M 141/10*** | (2006.01) |
| ***C10N 10/04*** | (2006.01) |
| ***C10N 40/02*** | (2006.01) |
| ***C10N 40/04*** | (2006.01) |

(52) U.S. Cl.

CPC .... *C10M 141/10* (2013.01); *C10M 2203/003* (2013.01); *C10M 2209/084* (2013.01); *C10M 2219/022* (2013.01); *C10M 2219/106* (2013.01); *C10M 2223/043* (2013.01); *C10M 2223/045* (2013.01); *C10M 2223/047* (2013.01); *C10N 2010/04* (2013.01); *C10N 2040/02* (2013.01); *C10N 2040/04* (2013.01)

(58) Field of Classification Search

CPC ..... C10M 141/10; C10M 2203/003; C10M 2209/084; C10M 2219/022; C10M 2219/106; C10M 2223/043; C10M 2223/045; C10M 2223/047; C10N 2010/04; C10N 2030/54; C10N 2040/02; C10N 2040/04

See application file for complete search history.

(56) References Cited

U.S. PATENT DOCUMENTS

| | | | | |
|---|---|---|---|---|
| 4,119,550 | A | 10/1978 | Davis et al. | |
| 4,764,297 | A | 8/1988 | Sowerby et al. | |
| 2006/0063685 | A1* | 3/2006 | Purmer | C10M 141/10 508/273 |
| 2018/0312775 | A1* | 11/2018 | Patterson | C10M 101/02 |
| 2019/0078035 | A1* | 3/2019 | Kassir | C10M 137/08 |

FOREIGN PATENT DOCUMENTS

| | | |
|---|---|---|
| CN | 103740444 A | 4/2014 |
| WO | 97/14770 | 4/1997 |

* cited by examiner

*Primary Examiner* — James C Goloboy

(74) *Attorney, Agent, or Firm* — Christopher P. Demas; Michael A. Miller

(57) ABSTRACT

The disclosed technology relates to an automotive or industrial gear oil for automotive or industrial gears, as well as axles and bearings, the automotive or industrial gear oil containing an oil of lubricating viscosity, an optional phosphate and/or thiophosphate compound, a particular sulfurized olefin, and a metal thiophosphate compound, such as zinc dialkyldithiophosphate, as well as a method of improving automotive or industrial gear operating efficiency and temperature by lubricating such automotive or industrial gears with the automotive or industrial gear oil.

25 Claims, No Drawings

METHOD OF LUBRICATING AN AUTOMOTIVE OR INDUSTRIAL GEAR

CROSS REFERENCE TO RELATED APPLICATION

This application claims priority from PCT Application Serial No. PCT/US21/027869 filed on Apr. 19, 2021, which claims the benefit of U.S. Provisional Application No. 63/015,884 filed on Apr. 27, 2020, the entirety of which is hereby incorporated by reference.

BACKGROUND

The disclosed technology relates to a lubricant composition for automotive or industrial gears, as well as axles and bearings, the automotive or industrial gear oil containing an oil of lubricating viscosity, an optional phosphate and/or thiophosphate compound, a particular sulfurized olefin, and a metal thiophosphate compound, such as zinc dialkyldithiophosphate, as well as a method of improving automotive or industrial gear operating efficiency and temperature by lubricating such automotive or industrial gears with the automotive or industrial gear oil.

Driveline power transmitting devices (such as gears or transmissions) present highly challenging technological problems and solutions for satisfying the multiple and often conflicting lubricating requirements, while providing durability and cleanliness.

Improving operating efficiency is a common goal shared by both original equipment manufacturers and lubricant manufacturers. Original equipment manufacturers may focus on using mechanical processing methods to reduce surface roughness in an effort to improve operating efficiency and reduce power loss. These mechanical processing methods include honing, top polishing, and vibratory finishing. Alternatively, lubricant manufacturers often target optimizing viscosity and lowering fluid traction coefficients in their efforts to optimize operating efficiency. Current mechanical processing methods can be expensive and time consuming to implement for large scale automotive gear production. Therefore, there is a desire to improve operating efficiency by modifying fluid properties, instead of relying on mechanical processes to achieve this goal.

U.S. Pat. No. 10,316,712, granted Jun. 11, 2019 to Douglass et al., teaches the use of various additives to reduce the roughness of additive manufactured articles to maximize energy efficiency. The data in the '712 patent suggests that many different additives can function to reduce surface roughness, and in fact, that even an un-additized lubricant oil can reduce surface roughness. The '712 patent does not teach how to provide any other benefit to the lubricating oil, for example, such as providing the requisite performance in ASTM D7452, ASTM D6121, ASTM D4172 or ASTM D5704.

While measurements of surface roughness and traction coefficients are often used as predictive tools for understanding the contribution of a lubricating fluid to improved efficiency, a more direct route to determine operating efficiency is to record power loss in an electric motor driven axle efficiency rig as it performs a drive cycle. Rig testing is preferred over vehicle testing to improve reproducibility and repeatability. Operating efficiency is related to power loss by the equation: % efficiency=[(power in−power loss)/power in]*100%. Efficiency, or power loss, can also be related to operating temperature, as has been reported in the literature (Barton, W. et al., "Impact of Viscosity Modifiers on Gear Oil Efficiency and Durability: Part II, SAE International 01-0299, 2013, pp 295-309, doi: 10.4271/2013-01-0299, U.S. Pat. Nos. 8,435,932, 6,303,547). Operating temperature closely correlates with operating efficiency. Operating inefficiencies generate heat, which results in higher operating temperatures. Therefore, lower operating temperatures are observed when less heat is generated in more efficient systems. A lubricant solution that can minimize power loss and operating temperature resulting in improved fluid efficiency would be technically and commercially beneficial.

SUMMARY

The use of a particular sulfurized olefin mixture along with metal alkylthiophosphate chemistry not common to gear oil use and an optional amine alkyl(thio)phosphate chemistry was found to be surprisingly beneficial in minimizing power losses and reducing operation temperatures.

One aspect of the technology is therefore directed to an automotive or industrial gear oil comprising an oil of lubricating viscosity, from 0.01 to 10 wt % of a sulfurized olefin, and from 0.1 to 2 wt %, or 0.2 to 1.9 wt %, or 0.2 to 1 wt %, or 1.0 to 1.8 wt % of a metal alkylthiophosphate. The lubricant can optionally include from 0.5 to 2.0 wt % of an amine alkyl(thio)phosphate compound.

The sulfurized olefin can be the reaction product of an olefin containing from two to six carbon atoms reacted with hydrogen sulfide and sulfur under superatmospheric pressure in the presence of a catalyst. In an embodiment, the sulfurized olefin can be a mixture of sulfurized olefins of formula $R_1$—$S_x$—$R_2$ where $R_1$ and $R_2$ separately are derived from 2 to 6 carbon atom containing olefins and x is an integer of between 1 and 10, with the proviso that the sulfurized olefin will have a sulfur content of from about 10 to about 50 wt %.

In embodiments, the amine alkylthiophosphate can be a dialkyldithiophosphate.

The metal alkylthiophosphate in the automotive or industrial gear oil can include a zinc dialkyldithiophosphate. In some embodiments, the zinc dialkyldithiophosphate can be a secondary zinc dialkyldithiophosphate.

In embodiments, the amine alkyl(thio)phosphate can be simply an amine alkylphosphate. In other embodiments, the amine alkyl(thio)phosphate can be an amine alkylthiophosphate. In further embodiments, the amine alkyl(thio)phosphate can include a combination of both amine phosphate and amine alkylthiophosphate.

In an embodiment, the lubricant can include an amine phosphate that is a substantially sulfur-free alkyl phosphate amine salt having at least about 30 mole percent of the phosphorus atoms in an alkyl pyrophosphate salt structure. In some embodiments, at least about 80 mole percent of the alkyl groups in such a sulfur-free alkyl phosphate can be secondary alkyl groups of about 3 to about 12 carbon atoms. In some embodiments, at least about 25 mole percent of the alkyl groups in such a sulfur-free alkyl phosphate can be primary alkyl groups of about 3 to about 12 carbon atoms.

The automotive or industrial gear oil can also contain other additives. In an embodiment, the automotive or industrial gear oil can include other sulfur containing additives in an amount to provide the composition with a total sulfur level of about 0.75 to about 5 wt %. In an embodiment, the automotive or industrial gear oil can have a total phosphorus level of about 0.01 to about 0.5 wt %.

Another aspect of the technology encompasses a method of lubricating a driveline power transmitting device by supplying to the driveline power transmitting device an automotive or industrial gear oil as described, and operating the driveline power transmitting device. The driveline power transmitting device can be, for example, an axle, a bearing, a transmission or a gear.

DETAILED DESCRIPTION

Various preferred features and embodiments will be described below by way of non-limiting illustration. One aspect of the invention is an automotive or industrial gear oil containing (a) an oil of lubricating viscosity, (b) a sulfurized olefin or mixture thereof, (c) a metal alkylthiophosphate, and optionally, (d) at least one amine alkyl(thio)phosphate.

Oil of Lubricating Viscosity

One component of the disclosed technology is an oil of lubricating viscosity, also referred to as a base oil. The base oil may be selected from any of the base oils in Groups I-V of the American Petroleum Institute (API) Base Oil Interchangeability Guidelines (2011), namely

| Base Oil Category | Sulfur (%) | Saturates (%) | Viscosity Index |
|---|---|---|---|
| Group I | >0.03 and/or | <90 | 80 to less than 120 |
| Group II | ≤0.03 and | ≥90 | 80 to less than 120 |
| Group III | ≤0.03 and | ≥90 | ≥120 |
| Group IV | All polyalphaolefins (PAOs) | | |
| Group V | All others not included in Groups I, II, III or IV | | |

Groups I, II and III are mineral oil base stocks. Other generally recognized categories of base oils may be used, even if not officially identified by the API: Group II+, referring to materials of Group II having a viscosity index of 110-119 and lower volatility than other Group II oils; and Group III+, referring to materials of Group III having a viscosity index greater than or equal to 130. The oil of lubricating viscosity can include natural or synthetic oils and mixtures thereof. Mixtures of mineral oil and synthetic oils, e.g., polyalphaolefin oils and/or polyester oils, may be used.

In one embodiment the oil of lubricating viscosity has a kinematic viscosity at 100° C. by ASTM D445 of 1.5 to 7.5, or 2 to 7, or 2.5 to 6.5, or 3 to 6 $mm^2/s$. In one embodiment the oil of lubricating viscosity comprises a poly alpha olefin having a kinematic viscosity at 100° C. by ASTM D445 of 1.5 to 7.5 or any of the other aforementioned ranges.

The Sulfurized Olefin

The sulfurized olefins employed in the present technology encompass mixtures, the compositions of which are not easily described aside from the reaction used to prepare them. In general, the sulfurized olefins are about 80% polysulfides, mostly di-t-butyl polysulfides, with a range of sulfur atoms of between 3 and 8. The mixtures may be generically represented by the formula: $R_1$—$S_x$—$R_2$, where $R_1$ and $R_2$ separately are derived from 2 to 6 carbon atom containing olefins and x is an integer of between 1 and 10, with the proviso that the sulfurized olefin will have a sulfur content of from about 10 to about 50 wt %.

To be more particular, the sulfurized olefins are the reaction products of olefins containing from two to six carbon atoms reacted with hydrogen sulfide and sulfur under super-atmospheric pressure in the presence of a catalyst.

Olefinic compounds which may be sulfurized by the method of this invention are diverse in nature and may be substituted or un-substituted. The nature of the substituents if/when the olefin is substituted is not normally a critical aspect of the technology and any such substituent is useful so long as it is or can be made compatible with lubricating environments and does not interfere under the contemplated reaction conditions. Thus, substituted compounds which are so unstable as to deleteriously decompose under the reaction conditions employed are not contemplated. However, certain substituents such as keto or aldehyde can desirably undergo sulfurization. The selection of suitable substituents is within the skill of the art or may be established through routine testing. Typical of such substituents include any of the above-listed moieties as well as hydroxy, amidine, amino, sulfonyl, sulfinyl, sulfonate, nitro, phosphate, phosphite, alkali metal mercapto and the like.

Example olefins from which the sulfurized olefin can be prepared can contain from 2 to 30 carbon atoms. In some cases the olefins can contain two to 16 carbon atoms. Often, the olefins can contain two to six carbon atoms. The sulfurized olefin may also be prepared from an olefin containing from three to five carbon atoms. The olefin can be butylene. The olefin can also be isobutylene. Amylene may also be employed as the olefin. The olefin may also be isoamylene. The olefin may also be diisobutylene. Sulfurized olefins suitable for use herein may be prepared from mixtures of any of the foregoing olefins.

The other two reagents which are essential in the method for preparing the sulfurized olefin, sulfur and hydrogen sulfide, are well known and are commercially available. Commercial sources of all these reagents are normally used, and impurities normally associated therewith may be present without adverse results.

The amounts of sulfur and hydrogen sulfide per mole of olefinic compound are, respectively, about 0.3-2.0 gram-atoms and about 0.1-1.5 moles. The preferred ranges are about 0.5-1.5 gram-atoms and about 0.4-1.25 moles respectively, and the most desirable ranges are about 0.7-1.2 gram-atoms and about 0.4-0.8 mole respectively.

The temperature range in which the sulfurization reaction is carried out is generally about 50°–350° C. The preferred range is about 100°–200° C., with about 125°-180° C. being especially suitable. The reaction is conducted under super-atmospheric pressure; this may be and usually is autogenous pressure (i.e., the pressure which naturally develops during the course of the reaction) but may also be externally applied pressure. The exact pressure developed during the reaction is dependent upon such fac-tors as the design and operation of the system, the reaction temperature, and the vapor pressure of the reactants and products and it may vary during the course of the reaction.

It is frequently advantageous to incorporate materials useful as sulfurization catalysts in the reaction mixture. These materials may be acidic, basic or neutral. Useful neutral and acidic materials include acidified clays such as "Super Filtrol", p-toluenesulfonic acid, dialkyl-phosphorodithioic acids, and phosphorus sulfides such as phosphorus pentasulfide. The preferred catalysts are basic materials. These may be inorganic oxides and salts such as sodium hydroxide, calcium oxide and sodium sulfide. The most desirable basic catalysts, however, are nitrogen bases including ammonia and amines. The amines includes primary, secondary and tertiary hydrocarbyl amines wherein the hydrocarbyl radicals are alkyl, aryl, aralkyl, alkaryl or the like and contain about 1-20 carbon atoms. Suitable amines include aniline, benzylamine, dibenzylamine, dodecylamine, naphthylamine, tallow amines, N-ethyldipropylamine, N-phenylbenzylamine, N,N-di-ethylbutylamine, m-toluidine and 2,3-xylidine. Also useful are heterocyclic amines such as pyrrolidine, N-methylpyrrolidine, piperidine, pyridine and quinoline.

The preferred basic catalysts include ammonia and primary, secondary, or tertiary alkylamines having about 1-8 carbon atoms in the alkyl radicals. Representative amines of this type are methylamine, dimethylamine, trimethylamine, ethylamine, diethylamine, triethylamine, di-n-butylamine, tri-n-butylamine, tri-sec-hexylamine and tri-n-octylamine. Mixtures of these amines can be used, as well as mixtures of ammonia and amines.

The amount of catalytic material used is generally about 0.05-2.0% of the weight of the olefinic compound. In the case of the preferred ammonia and amine catalysts, about 0.0005-0.5 mole per mole of olefin is preferred, and about 0.001-0.1 mole is especially desirable.

The exact chemical nature of the sulfurized olefins is not known with certainty, and it is most convenient to describe them in terms of the method for their preparation. It appears, however, that when prepared from olefins containing less than 7 carbon atoms, they comprise principally disulfides, trisulfides and tetrasulfides. The sulfur content of these sulfurized compositions is usually about 2-60% by weight, preferably about 25-60% and most desirably about 40-50%.

The foregoing sulfurized olefins are known in the art and further details can be found, for example, in U.S. Pat. Nos. 4,119,549; 4,191,659 and 4,344,854.

The foregoing sulfurized olefins are distinguishable from oligomeric polysulfides of $C_4S_x(C_4S_y)_bC_4$, where b can be 0 to 8, and x and y can be 1 to 3, such as those prepared by the processes taught, for example, in U.S. Pat. Nos. 2,708,199 and 3,697,499. Briefly, such oligomeric polysulfides are prepared by forming an adduct between 1 to 2 moles of olefin and a sulfur halide, followed by reacting the adduct with an alkali metal sulfide, optionally in the presence of free sulfur.

The amount of sulfurized olefin in the automotive or industrial gear oil may be 0.01 to 10 percent by weight. Alternative amounts of the sulfurized olefin may be 0.1 to 8 percent, or 0.2 to 6 percent, or 0.5 to 5 percent by weight. The amount of sulfurized olefin present may be suitable to provide sulfur to the lubricant formulation in an amount of 0.5 to 3 wt % sulfur. The amount may also be suitable to provide the lubricant formulation from 0.75 to 2.75 wt % sulfur. The amount may also be suitable to provide the lubricant formulation from 1 to 2.5 wt % sulfur.

As with the amine alkyl(thio)phosphate, it will be understood by the skilled person that the sulfurized olefin will typically comprise a mixture of various individual chemical species. Reference herein to a sulfurized olefin will be understood by those of ordinary skill to encompass mixtures of such compounds as may be prepared by the described syntheses.

The Metal Alkylthiophosphate Compound

The automotive or industrial gear oil will further include a metal alkylthiophosphate compound. The metal alkylthiophosphate compound can be represented by the formula:

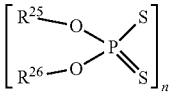

M wherein $R^{25}$ and $R^{26}$ are independently hydrogen, hydrocarbyl groups or mixtures thereof, provided that at least one of $R^{25}$ and $R^{26}$ is a hydrocarbyl group, preferably an alkyl or cycloalkyl with 1 to 30, or 2 to 20 and in some cases 2 to 15 carbon atoms. In certain embodiments, $R^{25}$ and $R^{26}$ can be secondary alkyl groups of 2 to 8 carbon atoms, or even from 3 to 6 carbon atoms, such as, for example, those derived from 4-methylpentan-2-ol or isopropanol. In some embodiments $R^{25}$ and $R^{26}$ can be secondary alkyl groups of 3 carbon atoms. In some embodiments $R^{25}$ and $R^{26}$ can be secondary alkyl groups of 6 carbon atoms.

M is a metal, and n is an integer equal to the available valence of M. M is mono- or di- or trivalent, preferably divalent, more preferably a divalent transition metal, and most preferably zinc.

Examples of metal alkylthiophosphates include zinc isopropyl methyl-amyl dithiophosphate, zinc isopropyl isooctyl dithiophosphate, zinc di(cyclohexyl)dithiophosphate, zinc isobutyl 2-ethylhexyl dithiophosphate, zinc isopropyl 2-ethylhexyl dithiophosphate, zinc isobutyl isoamyl dithiophosphate, zinc isopropyl n-butyl dithiophosphate, calcium di(hexyl)dithiophosphate, barium di(nonyl)dithiophosphate, zinc di(isobutyl) dithiophosphate, zinc isopropyl secondary-butyl dithiophosphate, zinc isopropyl dithiophosphate, zinc isopropyl 4-methylpentan-2-ol dithiophosphate, zinc 4-methylpentan-2-ol dithiophosphate or mixtures thereof.

The metal alkylthiophosphate may be a zinc dialkyldithiophosphate. Zinc dialkyldithiophosphates may be described as primary zinc dialkyldithiophosphates or as secondary zinc dialkyldithiophosphates, depending on the structure of the alcohol used in its preparation. In some embodiments the automotive or industrial gear oil can include a primary zinc dialkyldithiophosphate. In some embodiments the automotive or industrial gear oil can include a secondary zinc dialkyldithiophosphate. In some embodiments the automotive or industrial gear oil can include a mixture of primary and secondary zinc dialkyldithiophosphates.

Metal from the metal alkylthiophosphate, such as zinc, may be supplied at a concentration of from about 0.02 to about 0.095 wt % zinc, or from about 0.025 to 0.085 wt %, or even from about 0.03 to about 0.075 wt % zinc. Such levels may be associated with a metal alkylthiophosphate concentration of from about 0.15 to about 0.8 wt %, from about 0.2 to 0.75 wt %, or even from about 0.25 to about 0.70 wt %.

Metal from the metal alkylthiophosphate, such as zinc, may also be supplied at a concentration of from about 0.02 to about 0.2 wt % zinc, or from about 0.025 to 0.19 wt %, or even from about 0.03 to about 0.18 wt % zinc. Such levels may be associated with a metal alkylthiophosphate concentration of from about 0.2 to about 2 wt %, or from about 0.25 to 1.9 wt %, or even from about 0.3 to about 1.8 wt %.

In embodiments, the metal alkylthiophosphate can provide from 0.01 or from 0.02 to about 0.095 wt % phosphorus, or from about 0.025 to 0.085 wt %, or even from about 0.03 to about 0.075 wt % phosphorus.

In embodiments, the metal alkylthiophosphate can provide from 0.01 or from 0.02 to about 0.2 wt % phosphorus, or from about 0.025 to 0.19 wt %, or even from about 0.03 to about 0.18 wt % phosphorus.

Amine Alkyl(Thio)Phosphates

The lubricant of the disclosed technology will include at least one amine alkyl(thio)phosphate. As used herein, the inclusion of "thio" in the parenthesis means that the phosphate may or may not contain sulfur atoms.

In one embodiment, the amine alkyl(thio)phosphate can include an amine phosphate, that is, a phosphate that is substantially sulfur-free. By substantially sulfur free it is meant that sulfur is not intentionally added to the amine phosphate, and preferably the amine phosphate is completely free of sulfur. However, it is recognized that in production situations some sulfur contamination may occur, resulting in some sulfur in the amine phosphate. To the extent the amine phosphate contains some sulfur contamination, such contaminated compound will still be considered to be substantially sulfur free if the sulfur does not affect the basic characteristics of the amine phosphate. Generally, sulfur contamination levels may be less than 2.5%, or 1%, 0.1%, or 0.01% by weight to be considered substantially sulfur free.

In an embodiment, the amine phosphate may include at least 30 mole percent of the phosphorus atoms in an alkyl pyrophosphate structure, as opposed to an orthophosphate (or monomeric phosphate) structure. The percentage of phosphorus atoms in the pyrophosphate structure may be 30 to 100 mole %, or 40 to 90% or 50 to 80% or 55 to 70% or 55 to 65%. The remaining amount of the phosphorus atoms may be in an orthophosphate structure or may consist, in part, in unreacted phosphorus acid or other phosphorus species. In one embodiment, up to 60 or up to 50 mole percent of the phosphorus atoms are in mono- or di-alkyl-orthophosphate salt structure.

In an embodiment, the amine phosphate, as present in the pyrophosphate form, may be represented in part by a half neutralized salt of formula (I) and/or a fully neutralized salt as in formula (II).

(I)

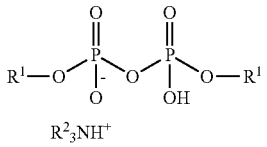

(II)

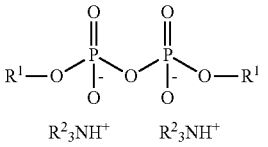

The extent of neutralization of the amine phosphate in practice, that is, the degree of salting of the —OH groups of the phosphorus esters, may be 50% to 100%, or 80% to 99%, or 90% to 98%, or 93% to 97%, or about 95%. Variants of these materials may also be present, such as a variant of formula (I) or formula (II) wherein the —OH group (in (I) is replaced by another —$OR^1$ group or wherein one or more —$OR^1$ groups are replaced by —OH groups, or wherein an $R^1$ group is replaced by a phosphorus-containing group, that is, those comprising a third phosphorus structure in place of a terminal $R^1$ group. Illustrative variant structures may include the following:

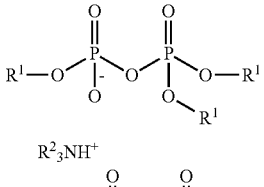

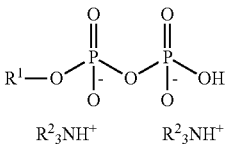

-continued

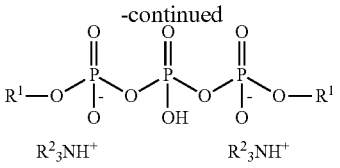

The structures of formulas (I) and (II) are shown as entirely sulfur-free species, in that the phosphorus atoms are bonded to oxygen, rather than sulfur atoms. However, it is possible that a small molar fraction of the 0 atoms could be replaced by S atoms, such as 0 to 5 percent or 0.1 to 4 percent or 0.2 to 3 percent or 0.5 to 2 percent.

The pyrophosphate salts may be distinguished from orthophosphate salts of the general structure

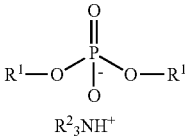

which optionally may also be present in amounts as indicated above.

The amine phosphate may also include some amount of partial esters including mono- and diesters of the orthophosphate structure and diesters of the pyrophosphate structure.

In formulas (I) and (II), each $R^1$ is independently an alkyl group of 3 to 12 carbon atoms. The alkyl groups may be primary or secondary groups, or a mixture of both primary and secondary. In certain embodiments at least 80 mole percent, or at least 85, 90, 95, or 99 percent, of the $R^1$ alkyl groups will be secondary alkyl groups. In certain embodiments at least 25 mole percent, or at least 30, 40, 50, 60, 70, 80 or 90 or even 99 mole percent, of the $R^1$ alkyl groups will be primary alkyl groups.

In some embodiments the alkyl groups will have 3 or 4 to 12 carbon atoms, or 3 to 8, or 4 to 6, or 5 to 10, or 6 to 8 carbon atoms. The alkyl groups can be straight chain, branched, cyclic or aromatic. Such groups include 2-butyl, 2-pentyl, 3-pentyl, 3-methyl-2-butyl, 2-hexyl, 3-hexyl, cyclohexyl, 4-methyl-2-pentyl, and other such secondary groups and isomers thereof having 6, 7, 8, 9, 10, 11, or 12 carbon atoms as well as propyl, butyl, isobutyl, pentyl, 3-methylbutyl, 2-methylbutyl, hexyl, heptyl, octyl, nonyl, decyl, undecyl, dodecyl, phenethyl, and other such primary groups and isomers thereof having 3, 4, 5, 6, 7, 8, 9, 10, 11, or 12 carbon atoms. In some embodiments the alkyl group will have a methyl branch at the □-position of the group, an example being the 4-methyl-2-pentyl (also referred to as 4-methylpent-2-yl) group.

The amine alkyl(thio)phosphate may also be an amine alkylthiophosphate, wherein the alkylthiophosphate is represented by the formula $(R'O)_2PSSH$, wherein each R' is independently a hydrocarbyl group containing from about 3 to about 30, preferably from about 3 up to about 18, or from about 3 up to about 12, or from up to about 8 carbon atoms. Example R' groups can include isopropyl, isobutyl, n-butyl, sec-butyl, the various amyl, n-hexyl, methylisobutyl carbinyl, heptyl, 2-ethylhexyl, isooctyl, nonyl, behenyl, decyl, dodecyl, and tridecyl groups. Illustrative lower alkylphenyl R' groups include butylphenyl, amylphenyl, heptylphenyl, etc. Examples of mixtures of R' groups include: 1-butyl and 1-octyl; 1-pentyl and 2-ethyl-1-hexyl; isobutyl and n-hexyl;

isobutyl and isoamyl; 2-propyl and 2-methyl-4-pentyl; isopropyl and sec-butyl; and isopropyl and isooctyl.

In one embodiment, the alkylthiophosphate of the amine alkylthiophosphate may be reacted with an epoxide or a polyhydric alcohol, such as glycerol. This reaction product may be used alone, or further reacted with a phosphorus acid, anhydride, or lower ester. The epoxide is generally an aliphatic epoxide or a styrene oxide. Examples of useful epoxides include ethylene oxide, propylene oxide, butene oxide, octene oxide, dodecene oxide, styrene oxide, etc. Ethylene oxide and propylene oxide are preferred. The glycols may be aliphatic glycols having from 2 to about 12, or from about 2 to about 6, or from 2 or 3 carbon atoms. Glycols include ethylene glycol, propylene glycol, and the like. The alkylthiophosphate, glycols, epoxides, inorganic phosphorus reagents and methods of reacting the same are described in U.S. Pat. Nos. 3,197,405 and 3,544,465 which are incorporated herein by reference for their disclosure to these.

Amine Component—The amine component of the amine alkyl(thio)phosphate may be represented by $R^2{}_3NH$, where each $R^2$ is independently hydrogen or a hydrocarbyl group or an ester-containing group, or an ether-containing group, provided that at least one $R^2$ group is a hydrocarbyl group or an ester-containing group or an ether-containing group (that is, not $NH_3$). Suitable hydrocarbyl amines include primary amines having 1 to 18 carbon atoms, or 3 to 12, or 4 to 10 carbon atoms, such as methylamine, ethylamine, propylamine, isopropylamine, butylamine and isomers thereof, pentylamine and isomers thereof, hexylamine and isomers thereof, heptylamine and isomers thereof, octylamine and isomers thereof such as isooctylamine and 2-ethylhexylamine, as well as higher amines. Other primary amines include dodecylamine, fatty amines as n-octylamine, n-decylamine, n-dodecylamine, n-tetradecylamine, n-hexadecylamine, n-octadecylamine and oleylamine. Other useful fatty amines include commercially available fatty amines such as "Armeen®" amines (products available from Akzo Chemicals, Chicago, Ill.), such as Armeen® C, Armeen® O, Armeen® OL, Armeen® T, Armeen® HT, Armeen® S and Armeen® SD, wherein the letter designation relates to the fatty group, such as coco, oleyl, tallow, or stearyl groups.

Secondary amines that may be used include dimethylamine, diethylamine, dipropylamine, dibutylamine, diamylamine, dihexylamine, diheptylamine, methylethyl-amine, ethylbutylamine, bis-2-ethylhexylamine, N-methyl-1-aminocyclohexane, Armeen® 2C, and ethylamylamine. The secondary amines may be cyclic amines such as piperidine, piperazine and morpholine.

Suitable tertiary amines include tri-n-butylamine, tri-n-octylamine, tri-decylamine, tri-laurylamine, tri-hexadecylamine, and dimethyloleylamine (Armeen® DMOD). Triisodecylamine or tridecylamine and isomers thereof may be used.

Examples of mixtures of amines include (i) an amine with 11 to 14 carbon atoms on tertiary alkyl primary groups, (ii) an amine with 14 to 18 carbon atoms on tertiary alkyl primary groups, or (iii) an amine with 18 to 22 carbon atoms on tertiary alkyl primary groups. Other examples of tertiary alkyl primary amines include tert-butylamine, tert-hexylamine, tert-octylamine (such as 1,1-dimethylhexylamine), tert-decylamine (such as 1,1-dimethyloctylamine), tert-dodecylamine, tert-tetradecylamine, tert-hexadecylamine, tert-octadecylamine, tert-tetracosanylamine, and tert-octacosanylamine. In one embodiment a useful mixture of amines includes "Primene® 81R" or "Primene® JMT." Primene® 81R and Primene® JMT (both produced and sold by Dow Chemical) may be mixtures of C11 to C14 tertiary alkyl primary amines and C18 to C22 tertiary alkyl primary amines, respectively.

In other embodiments the amine may be an ester-containing amine such as an N-hydrocarbyl-substituted γ- or δ-amino(thio)ester, which is therefore a secondary amine. The ester-containing amine, may, for example, be prepared by Michael addition of a primary amine, typically having a branched hydrocarbyl group, with an ethylenically unsaturated ester or thio ester, or, for example, by reductive amination of the esters of 5-oxy substituted carboxylic acids or 5-oxy substituted thiocarboxylic acids. They may also be prepared by amination of the esters of 5-halogen substituted carboxylic acids or 5-halogen substituted thiocarboxylic acids, or by reductive amination of the esters of 2-amino substituted hexanedioic acids, or by alkylation of the esters of 2-aminohexanedioic acids.

The amine, of whatever type, will be reacted to neutralize the acidic group(s) on the phosphorus ester component, to prepare the amine alkyl(thio)phosphate.

In an embodiment, the amine alkyl(thio)phosphate may be a phosphate amine of formulas (I) or (II), or variants thereof, with the amine being 2-ethylhexylamine.

In an embodiment, the amine alkyl(thio)phosphate may be an amine phosphate of formulas (I) or (II), or variants thereof, with the amine being an N-hydrocarbyl-substituted γ- or δ-amino(thio)ester.

In one embodiment the amine alkyl(thio)phosphate can be an amine alkylthiophosphate that is the reaction product of a $C_{14}$ to $C_{18}$ alkylated dialkyldithiophosphoric acid with Primene 81R™ (produced and sold by Dow) which is a mixture of $C_{11}$ to $C_{14}$ tertiary alkyl primary amines.

In embodiments, the amine alkyl(thio)phosphate can include combinations of amine phosphates, combinations of amine alkylthiophosphates, and combinations of amine phosphates with amine alkylthiophosphates.

The amount of amine alkyl(thio)phosphate in the automotive or industrial gear oil may be 0.01 to 5 percent by weight. Alternative amounts of the amine alkyl(thio)phosphate may be 0.2 to 3 percent, or 0.6 to 2 percent, or even 0.7 to 1.75 percent, or 0.2 to 1.2 percent, or 0.5 to 2.0 percent, or 0.55 to 1.4 percent, or 0.6 to 1.3 percent, or 0.7 to 1.2, or 1 to 2, or even 1.5 to 2, or 1.2 to 1.8 percent by weight or even from 1.8 to 2.2 percent by weight. The amount may be suitable to provide phosphorus to the lubricant formulation in an amount of 200 to 3000 parts per million by weight (ppm), or 400 to 2000 ppm, or 300 to 2000, or 600 to 1500 ppm, or 700 to 1100 ppm, or 900 to 1900, or 1100 to 1800 ppm, or 1200 to 1600 ppm or 1500 to 2000 ppm.

It will be understood by the skilled person that the amine alkyl(thio)phosphate will typically comprise a mixture of various individual chemical species. Reference herein to an amine alkyl(thio)phosphate will be understood by those of ordinary skill to encompass mixtures of such compounds as may be prepared by the described syntheses.

Other Additives

The automotive or industrial gear oil can also contain thiadiazoles and thiadiazole adducts such as post treated dispersants. Examples of a thiadiazole include 2,5-dimercapto-1,3,4-thiadiazole, or oligomers thereof, a hydrocarbyl-substituted 2,5-di-mercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulfur-sulfur bond between 2,5-dimercapto-1,3,4-thiadiazole units to form oligomers of two or more of said thiadiazole units. Further examples of thiadiazole compounds are found in WO 2008,094759, paragraphs 0088 through 0090. The thiadiazoles can be included at concentrations of from about 0.01 to about 2 wt %, or about 0.05 to about 1.5 wt %, or even 0.1 to about 1 wt %.

Other materials may be present in the automotive or industrial gear oil in their conventional amounts including, for example, viscosity modifiers, dispersants, pour point additives, extreme pressure agents, antifoams, copper anticorrosion agents (such as dimercaptothiadiazole compounds), iron anticorrosion agents, friction modifiers, dyes, fragrances, optional detergents and antioxidants, and color stabilizers, for example.

An automotive or industrial gear oil, as used herein, refers to an automotive or industrial gear oil having sufficient levels of additive to lubricate an industrial gear or driveline power transmitting device, including an automotive gear, such as a gear, bearing or axle, or a transmission. In this regard, an automotive or industrial gear oil can be distinguished from other lubricants, such as engine oil lubricants, based on levels of sulfur and phosphorus. The automotive or industrial gear oil can have a total sulfur level of about 0.75 to about 5 wt. % based on the weight of the automotive or industrial gear oil. In some embodiments, the total sulfur level can be from about 0.8 to about 4 wt. %, or even about 0.9 to about 3.5 wt. % or about 1 to about 3 wt. %.

The automotive or industrial gear oil can also have a total phosphorus level of about 0.01 to about 0.5 wt. %, or 0.03 to about 0.35 wt. %, or even about 0.05 to about 0.3 wt. %.

The phosphorus can be brought to the automotive or industrial gear oil, for example, from the amine alkyl(thio) phosphate discussed above, or other phosphorus containing compounds. Such other phosphorus containing compounds can include, for example, phosphites or phosphonates. Suitable phosphites or phosphonates include those having at least one hydrocarbyl group with 3 or 4 or more, or 8 or more, or 12 or more, carbon atoms. The phosphite may be a mono-hydrocarbyl substituted phosphite, a di-hydrocarbyl substituted phosphite, or a tri-hydrocarbyl substituted phosphite. The phosphonate may be a mono-hydrocarbyl substituted phosphonate, a di-hydrocarbyl substituted phosphonate, or a tri-hydrocarbyl substituted phosphonate.

In one embodiment the phosphite is sulphur-free i.e., the phosphite is not a thiophosphite.

The phosphite or phosphonate may be represented by the formulae:

XI

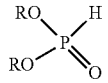

XII

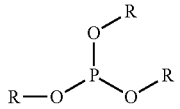

wherein at least one R may be a hydrocarbyl group containing at least 3 carbon atoms and the other R groups may be hydrogen. In one embodiment, two of the R groups are hydrocarbyl groups, and the third is hydrogen. In one embodiment every R group is a hydrocarbyl group, i.e., the phosphite is a tri-hydrocarbyl substituted phosphite. The hydrocarbyl groups may be alkyl, cycloalkyl, aryl, acyclic or mixtures thereof.

In the art, a phosphonate (i.e., formula XI with R=hydrocarbyl) may also be referred to as a phosphite ester. Where one of the R groups in formula XII is an H group, the compound would generally be considered a phosphite, but such a compound can often exist in between the tautomers of formula XI and XII, and thus, could also be referred to as a phosphonate or phosphite ester. For ease of reference, the term phosphite, as used herein, will be considered to encompass both phosphites and phosphonates.

The R hydrocarbyl groups may be linear or branched, typically linear, and saturated or unsaturated, typically saturated.

In one embodiment, the other phosphorus-containing compound can be a $C_{3-8}$ hydrocarbyl phosphite, or mixtures thereof, i.e., wherein each R may independently be hydrogen or a hydrocarbyl group having 3 to 8, or 4 to 6 carbon atoms, typically 4 carbon atoms. Typically the $C_{3-8}$ hydrocarbyl phosphite comprises dibutyl phosphite.

In one embodiment, the phosphorus-containing compound can be a $C_{12-22}$ hydrocarbyl phosphite, or mixtures thereof, i.e., wherein each R may independently be hydrogen or a hydrocarbyl group having 12 to 24, or 14 to 20 carbon atoms, typically 16 to 18 carbon atoms. Typically the $C_{12-22}$ hydrocarbyl phosphite comprises a $C_{16-18}$ hydrocarbyl phosphite. Examples of alkyl groups for $R^3$, $R^4$ and $R^5$ include octyl, 2-ethylhexyl, nonyl, decyl, undecyl, dodecyl, tridecyl, tetradecyl, pentadecyl, hexadecyl, heptadecyl, octadecyl, octadecenyl, nonadecyl, eicosyl or mixtures thereof. The $C_{12-22}$ hydrocarbyl phosphite may be present in the automotive or industrial gear oil at about 0.05 wt. % to about 4.0 wt. % of the automotive or industrial gear oil, or from about 0.05 wt. % to about 3 wt. %, or from about 0.05 wt. % to about 1.5 wt. %, or from about 0.05 wt. % to about 1 wt. %, or from about 0.1 wt. % to about 0.5 wt. % of the automotive or industrial gear oil.

In some embodiments, the other phosphorus containing compound can include both a $C_{3-8}$ and a $C_{12}$ to $C_{24}$ hydrocarbyl phosphite.

In one embodiment, the phosphite ester comprises the reaction product of (a) a monomeric phosphoric acid or an ester thereof with (b) at least two alkylene diols; a first alkylene diol (i) having two hydroxy groups in a 1,4 or 1,5 or 1,6 relationship; and a second alkylene diol(ii) being an alkyl-substitute 1,3-propylene glycol.

Sulfur containing phosphites can include, for example, a material represented by the formula $[R^1O(OR^2)(S)PSC_2H_4(C)(O)OR^4O]_nP(OR^5)_{2-n}(O)H$, wherein $R^1$ and $R^2$ are each independently hydrocarbyl groups of 3 to 12 carbon atoms, or 6 to 8 carbon atoms, or wherein $R^1$ and $R^2$ together with the adjacent 0 and P atoms form a ring containing 2 to 6 carbon atoms; $R^4$ is an alkylene group of 2 to 6 carbon atoms or 2 to 4 carbon atoms; $R^5$ is hydrogen or a hydrocarbyl group of 1 to about 12 carbon atoms; and n is 1 or 2. The $C_{12-22}$ hydrocarbyl phosphite may be present in the automotive or industrial gear oil at about 0.05 wt. % to about 1.5 wt. % of the automotive or industrial gear oil, or from about 0.1 wt. % to about 1.0 wt. % of the automotive or industrial gear oil.

In one embodiment, the other phosphorus containing compound can be a phosphorus containing amide. Phosphorus containing amides can be prepared by reaction of dithiophosphoric acid with an unsaturated amide. Examples of unsaturated amides include acrylamide, N,N'-methylene bisacrylamide, methacrylamide, crotonamide and the like. The reaction product of the phosphorus acid and the unsaturated amide may be further reacted with a linking or a coupling compound, such as formaldehyde or paraformaldehyde. The phosphorus containing amides are known in the art and are disclosed in U.S. Pat. Nos. 4,670,169, 4,770,807 and 4,876,374 which are incorporated by reference for their disclosures of phosphorus amides and their preparation.

The automotive or industrial gear oil can also include a rust inhibitor. Rust inhibitors include organic compounds having one or more of an amine group, an ether group, a hydroxyl group, a carboxylic acid, ester, or salt group, or a nitrogen-containing heterocyclic group. Examples include fatty amines such as oleylamine, hydroxyamines such as isopropanolamine; condensates of hydroxyamines with fatty acids (such as the product of tall oil fatty acid with diethanolamine or with N-hydroxyethylethylenediamine), carboxylic acids, esters, and salts (such as alkyl substituted succinic acids, esters, and amine or ammonium salts, e.g., the mono- or di-ester from a succinic acid and propylene oxide), and compounds with multiple functionalities. Examples of the latter include sarcosine derivatives, having amide and acid functionality (e.g., $R^1CO—NR^2—CH_2—COOH$). Materials with nitrogen-containing heterocyles include triazole compounds such as tolyltriazole and triazine salts. Other rust inhibitors include ethoxylated phenols. Other rust inhibitors include various oxygenated materials that may be formed by partial oxidation of waxes or oils. Examples include paraffinic oil oxidates, wax oxidates, and petroleum oxidates. Other rust inhibitors include organic boron compounds such as long chain alkenyl amide borates. Yet others include alkali metal sulfonates such as sodium sulfonates and sodium alkylbenzenesulfonates.

Other rust inhibitors include esters of hydroxy-acids such as tartaric acid, citric acid, malic acid, lactic acid, oxalic acid, glycolic acid, hydroxypropionic acid, and hydroxyglutaric acid. Examples of these include esters, including tartrate esters (that is, especially the diesters), formed from $C_{6-12}$ or $C_{6-10}$ or $C_{8-10}$ alcohols, e.g., isotridecyl tartrate, 2-ethylhexyl tartrate, and mixed tartrate esters of $C_{12-14}$ linear alcohol/$C_{13}$ branched alcohol (e.g., 80-95:20-5 ratios or 90:10 ratio). Amides and imides of such materials may also be useful.

Yet other rust inhibitors include polyethers. These include polyalkylene oxides such as polyethylene oxide, polypropylene oxide, and copolymers of ethylene oxide and propylene oxide. Such polyethers may be capped at one end with an alkyl group such as a butyl group. Materials of this type are commercially available and are believed to be butyl-capped polypropylene oxides or butyl-capped ethylene oxide-propylene oxide copolymers. Such materials, if they contain a hydroxy group at one end of the chain, may also be referred to as polyether alcohols or polyether polyols.

In one embodiment the rust inhibitor can be a polyether. In other embodiments the rust inhibitor can be one or more of a fatty amine, a condensate of a hydroxyamine with a fatty acid, a carboxylic acid, ester, or salt, a sarcosine derivative, a triazole compound, an ethyoxylated phenol, a partially oxidized wax or oil, a long chain alkenyl amide borate, an ester of a hydroxy acid, or a sodium sulfonate.

The rust inhibitor can be present from 0.02 to 2 percent by weight of the automotive or industrial gear oil and in alternative embodiments 0.05 to 1 wt % or 0.1 to 0.5 wt % or 0.1 to 0.2 wt %.

The automotive or industrial gear oil may have a kinematic viscosity at 100° C. by ASTM D445 of between 2 and 25 cSt. The automotive or industrial gear oil may have a kinematic viscosity at 100° C. by ASTM D445 of between 2 and 15 cSt. The automotive or industrial gear oil may have a kinematic viscosity at 100° C. by ASTM D445 of between 2 and 12 cSt. The automotive or industrial gear oil may have a kinematic viscosity at 100° C. by ASTM D445 of between 2 and 9 cSt. The automotive or industrial gear oil may have a kinematic viscosity at 100° C. by ASTM D445 of between 2 and 7 cSt. The automotive or industrial gear oil may have a kinematic viscosity at 100° C. by ASTM D445 of between 2 and 6 cSt. The automotive or industrial gear oil may have a kinematic viscosity at 100° C. by ASTM D445 of between 2 and 5 cSt. The automotive or industrial gear oil may have a kinematic viscosity at 100° C. by ASTM D445 of between 3 and 6.5 cSt. The automotive or industrial gear oil may have a kinematic viscosity at 100° C. by ASTM D445 of between 3 and 5.5 cSt.

The disclosed technology in general provides a method of minimizing power loss and reducing operating temperature in an automotive or industrial gear by providing to an automotive or industrial gear the automotive or industrial gear oil, and operating the automotive or industrial gear.

The technology also provides a method of improving the operating efficiency of a gear, by lubricating the gear with the automotive or industrial gear oil and operating the gear. In particular, the technology provides a method of improving the operating efficiency of a new gear, by lubricating the gear with the automotive or industrial gear oil and operating the gear. By "new gear" it means a gear that has not been previously used in operation. Efficiency may also be improved in a used gear that was previously operated under a fluid outside the composition taught herein.

In particular, the disclosed technology provides a method of lubricating a driveline power transmitting device, comprising supplying thereto an automotive or industrial gear oil as described herein, that is, an automotive or industrial gear oil containing (a) an oil of lubricating viscosity, (b) the sulfurized olefins discussed herein, and (c) a metal alkylthiophosphate, or in some instance, (a) an oil of lubricating viscosity, (b) the sulfurized olefins discussed herein, (c) a metal alkylthiophosphate, and (d) an amine alkyl(thio)phosphate, and operating the driveline power transmitting device for a sufficient period to allow the automotive or industrial gear oil to minimize power losses and reduce operating temperatures of the driveline power transmitting device in a controlled manner to a greater extent than a typical gear lubricant. This reduction in power loss can be measured during operation of the device with the automotive or industrial gear oil.

The driveline power transmitting device may comprise at least two gears as in a gearbox of a vehicle (e.g., a manual transmission) or in an axle or differential, or in other driveline power transmitting devices. The driveline power transmitting device may also include bearings. The rolling elements of the bearings may be cylindrical or ball in design. Lubricated gears may include amboid, or spiral bevel, or more commonly hypoid gears, such as those for example in a drive axle. The axles may have a gear ratio of 2:1 to 8:1, and the ring gear may be be approximately 13 to 64 cm in diameter. The axle may incorporate an open differential or some type of traction enabling device. The axle may be part of a drivetrain with one or more drive axles, such as a tandem or tridem, in which the axles may be coupled together with a power divider. Application of these axles includes light, medium and heavy duty vehicles (e.g. vocational or line haul service), and could be used on or off highway. The axle may be from a traditional petroleum powered vehicle, may be from an electrically driven vehicle, or a hybrid thereof. The electrically driven axle can combine an electric motor, power electronics and transmission in a unit directly powering the vehicle's axle.

The lubricant should be able to meet the other aspects expected of it in normal operation of the driveline power transmitting device.

As used herein, the term "condensation product" is intended to encompass esters, amides, imides and other such materials that may be prepared by a condensation reaction of an acid or a reactive equivalent of an acid (e.g., an acid halide, anhydride, or ester) with an alcohol or amine, irrespective of whether a condensation reaction is actually performed to lead directly to the product. Thus, for example, a particular ester may be prepared by a transesterification reaction rather than directly by a condensation reaction.

The resulting product is still considered a condensation product.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

- hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);
- substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);
- hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

It is known that some of the materials described herein may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

The invention herein may be better understood with reference to the following examples.

EXAMPLES

A series of fully formulated automotive gear oils were prepared according to the formulations in Tables 1 and 2 below.

TABLE 1

| | Sample 1 | Sample 2 | Sample 3 | Sample 4 |
|---|---|---|---|---|
| Additive Package | 1.2 | 1.2 | 1.2 | 1.2 |
| Methacrylate copolymer | 9.0 | 9.0 | 9.0 | 9.0 |
| Phosphorus amine salt-1 | 1.66 | 1.66 | 1.66 | 1.66 |
| Sulfurized olefin A | 4.57 | | 2.3 | |
| Sulfurized olefin B | | 4.57 | | 2.3 |
| Zinc dialkyldithiophosphate | | | 1.4 | 1.4 |
| Oil of lubricating viscosity | Sum to 100 | Sum to 100 | Sum to 100 | Sum to 100 |
| KV at 100° C. | 6.12 | 5.82 | 6.18 | 6.08 |
| KV at 40° C. | 30.33 | 27.93 | 31.25 | 30.01 |

Phosphorus amine salt -1 contains sulfur

Samples 1 and 2 are identical with the exception of the sulfurized olefin present. Sample 1 contains sulfurized olefin A and Sample 2 contains sulfurized olefin B. Samples 3 and 4 are also identical with the exception of the sulfurized olefin present.

These samples differ from samples 1 and 2 in that they contain a reduced level of each of the sulfurized olefins, supplemented by the addition of the zinc dialkyldithiophosphate.

Sulfurized olefin A is an oligomeric polysulfide.

Sulfurized olefin B is a sulfurized isobutylene according to the instant technology.

Table 2 is very similar to Table 1 and represents recipes for four additional fluids. These samples are comparable to samples 1-4, but they all contain a different source of the phosphorus amine salt. The phosphorus amine salt present in Samples 1-4 contains sulfur, while the phosphorus amine salt in Samples 5-8 is substantially free of sulfur. Again, each fluid contains either sulfurized olefin A or sulfurized olefin B with and without the zinc dialkydithiophosphate.

TABLE 2

| | Sample 5 | Sample 6 | Sample 7 | Sample 8 |
|---|---|---|---|---|
| Additive Package | 1.2 | 1.2 | 1.2 | 1.2 |
| Methacrylate copolymer | 9.0 | 9.0 | 9.0 | 9.0 |
| Phosphorus amine salt-2 | 1.66 | 1.66 | 1.66 | 1.66 |
| Sulfurized olefin A | 4.57 | | 2.3 | |
| Sulfurized olefin B | | 4.57 | | 2.3 |
| Zinc dialkyldithiophosphate | | | 1.4 | 1.4 |
| Oil of lubricating viscosity | Sum to 100 | Sum to 100 | Sum to 100 | Sum to 100 |
| KV at 100° C. | 6.06 | 5.71 | 6.14 | 6.03 |
| KV at 40° C. | 29.88 | 27.2 | 30.69 | 29.71 |

Phosphorus amine salt - 2 is substantially free of sulfur

Axle efficiency testing was completed for each of the fluids according to the following guidelines and procedure:

The axles used are commercially available and were purchased from a North American tier I supplier with a 24 cm ring gear, open differential, and a 3.42:1 gear ratio. Each efficiency test was run with a new axle and no temperature control. The temperature was allowed to self-stabilize over time and the axle was tested over the full operating window of speeds and loads of the vehicle for which the axle was intended. Table 3 is a speed-load map that represents 16 sets of conditions that mimic low, medium, medium-high, and high speeds from 500 to 2000 rpm that would be encountered in city driving to highway driving, and a range of 100 to 500 Nm pinion forces that represent hauling various low, medium-low, medium, medium-high and high loads.

TABLE 3

| Stage | Speed (pinion, rpm) | Load (pinion, Nm) | Time in Stage (min) |
|---|---|---|---|
| 1 | 2000 | 100 | 30 |
| 2 | 1000 | 200 | 30 |
| 3 | 1500 | 200 | 30 |
| 4 | 2000 | 200 | 30 |
| 5 | 500 | 300 | 20 |
| 6 | 1000 | 300 | 20 |
| 7 | 1500 | 300 | 20 |
| 8 | 2000 | 300 | 20 |
| 9 | 500 | 400 | 20 |
| 10 | 1000 | 400 | 20 |
| 11 | 1500 | 400 | 20 |
| 12 | 2000 | 400 | 20 |
| 13 | 500 | 500 | 20 |
| 14 | 1000 | 500 | 20 |
| 15 | 1500 | 500 | 20 |
| 16 | 2000 | 500 | 20 |

The test runs sequentially through each stage 1-16. One cycle is completed after the fluid has been subjected once to all 16 stages. The test is repeated for 10 cycles. The power loss and fluid temperature are measured after each stage and recorded. The power loss and temperature data reported here are for stages 7, 11 and 16 of the procedure. These stages exposed the fluid to the range of operating conditions, from moderate to high loads and speeds. At the highest power stage, stage 16, it shows the largest difference in power loss and operating temperature more dramatically than other stages, but differences can also be seen at lower loads and speeds. Data from cycle 1, cycle 3 and cycle 10 is reported for each fluid. In an effort to reduce variability that is inherent in the testing because each of the tests was run on a new axle, selected tests were run in duplicate or in triplicate where indicated. Minimization of both power loss and operating temperature is most desirable.

TABLE 4

| | Power loss (kW) | | | Operating Temp (° C.) | | |
|---|---|---|---|---|---|---|
| | Cycle 1 | Cycle 3 | Cycle 10 | Cycle 1 | Cycle 3 | Cycle 10 |
| Stage 7 Data | | | | | | |
| Sample 1 | 1.27 | 1.00 | 0.97 | 101 | 85 | 78 |
| Sample 2 | 1.27 | 0.99 | 0.94 | 99 | 83 | 80 |
| Δ | 0 | 0.01 | 0.03 | 2 | 2 | 2 |
| % Change Sample 1 to Sample 2 | 0% | −1% | −3% | −2% | −2% | −2% |
| Sample 3 | 1.46 | 1.11 | 1.0 | 109 | 87 | 78 |
| Sample 4 | 1.08 | 0.93 | 0.90 | 92 | 80 | 78 |
| Δ | 0.38 | 0.18 | 0.10 | 17 | 7 | 0 |
| % Change Sample 3 to Sample 4 | −26% | −16% | −10% | −16% | −8% | −0% |
| Stage 11 Data | | | | | | |
| Sample 1 | 1.63 | 1.35 | 1.24 | 119 | 102 | 92 |
| Sample 2 | 1.49 | 1.28 | 1.19 | 113 | 100 | 94 |
| Δ | 0.14 | 0.07 | 0.05 | 6 | 2 | 2 |
| % Change Sample 1 to Sample 2 | −9% | −5% | −4% | −5% | −2% | −2% |
| Sample 3 | 1.7 | 1.76 | 1.4 | 122 | 116 | 98 |
| Sample 4 | 1.39 | 1.15 | 1.13 | 106 | 94 | 90 |
| Δ | 0.31 | 0.61 | 0.27 | 16 | 22 | 8 |
| % Change Sample 3 to Sample 4 | −18% | −35% | −19% | −13% | −19% | −8% |
| Stage 16 Data | | | | | | |
| Sample 1 | 2.44 | 2.18 | 1.98 | 150 | 138 | 124 |
| Sample 2 | 2.11 | 1.97 | 1.87 | 135 | 126 | 123 |
| Δ | 0.33 | 0.21 | 0.11 | 15 | 12 | 1 |
| % Change Sample 1 to Sample 2 | −14% | −10% | −6% | −10% | −9% | −1% |
| Sample 3 | 2.73 | 3.05 | 2.79 | 156 | 158 | 148 |
| Sample 4 | 1.94 | 1.80 | 1.77 | 128 | 118 | 116 |
| Δ | 0.79 | 1.25 | 1.02 | 28 | 40 | 32 |
| % Change Sample 3 to Sample 4 | −29% | −41% | −37% | −18% | −25% | −22% |

Sample 2 is average of three runs

In the absence of ZDDP, Samples 1 and 2 do not show a large differentiation between fluids containing either sulfurized olefin A or sulfurized olefin B. However, once the ZDDP is present in the fluids, there is a much larger difference in performance for Samples 3 and 4. Sample 4 containing both ZDDP and sulfurized olefin B shows the lowest power loss and the lowest operating temperature.

TABLE 5

| | Power loss (kW) | | | Operating Temp (° C.) | | |
|---|---|---|---|---|---|---|
| | Cycle 1 | Cycle 3 | Cycle 10 | Cycle 1 | Cycle 3 | Cycle 10 |
| Stage 7 | | | | | | |
| Sample 5 | 1.34 | 1.01 | 0.95 | 104 | 84 | 80 |
| Sample 6 | 1.6 | 0.96 | 0.90 | 114 | 80 | 78 |
| Δ | 0.24 | 0.05 | 0.05 | 10 | 4 | 2 |
| % Change Sample 5 to Sample 6 | +19% | −5% | −6% | +10% | −5% | −3% |
| Sample 7[1] | 1.28 | 1.02 | 0.97 | 104 | 85 | 82 |
| Sample 8 | 1.02 | 0.76 | 0.72 | 89 | 73 | 70 |
| Δ | 0.26 | 0.26 | 0.25 | 15 | 12 | 12 |
| % Change Sample 7 to Sample 8 | −20% | −25% | −26% | −14% | −14% | −15% |
| Stage 11 | | | | | | |
| Sample 5 | 1.67 | 1.36 | 1.24 | 121 | 103 | 94 |
| Sample 6 | 1.88 | 1.3 | 1.16 | 128 | 98 | 92 |
| Δ | 0.19 | 0.06 | 0.08 | 7 | 5 | 2 |
| % Change Sample 5 to Sample 6 | +13% | −4% | −6% | +6% | −5% | −2% |
| Sample 7[1] | 1.52 | 1.37 | 1.31 | 116 | 104 | 99 |
| Sample 8 | 1.2 | 0.97 | 0.92 | 100 | 86 | 83 |
| Δ | 0.32 | 0.40 | 0.39 | 16 | 18 | 16 |
| % Change Sample 7 to Sample 8 | −21% | −29% | −30% | −14% | −17% | −16% |
| Stage 16 | | | | | | |
| Sample 5 | 2.52 | 2.08 | 1.84 | 150 | 131 | 120 |
| Sample 6 | 2.31 | 2.15 | 1.96 | 144 | 136 | 121 |
| Δ | 0.21 | −0.07 | −0.12 | 6 | −5 | −1 |
| % Change Sample 5 to Sample 6 | −8% | +3% | +7% | −4% | +4% | +1% |

TABLE 5-continued

| | Power loss (kW) | | | Operating Temp (° C.) | | |
|---|---|---|---|---|---|---|
| | Cycle 1 | Cycle 3 | Cycle 10 | Cycle 1 | Cycle 3 | Cycle 10 |
| Sample 7ǂ | 2.43 | 2.39 | 2.27 | 148 | 144 | 139 |
| Sample 8 | 1.55 | 1.46 | 1.36 | 112 | 104 | 101 |
| Δ | 0.88 | 0.93 | 0.91 | 36 | 40 | 38 |
| % Change Sample 7 to Sample 8 | −36% | −39% | −40% | −24% | −28% | −27% |

ǂ Average of 2 runs

Comparison of the results from samples 5 and 6 that contain different sulfurized olefins in the absence of ZDDP, show very little difference in performance (Sample 5 contains sulfurized olefin A; Sample 6 contains sulfurized olefin B). However, in the presence of ZDDP, the fluid containing sulfurized olefin B (Sample 8) shows a clear performance improvement compared to the fluid containing sulfurized olefin A (Sample 7), as well as improvements over Samples 5 and Samples 6 that do not contain ZDDP.

In both sets of data, when only sulfurized olefin A or B is used as the extreme pressure (EP) agent, the power loss and operating temperature are similar regardless of the phosphorus antiwear agent. However, when zinc dialkyldithiophsophate is introduced as part of the EP system, there is substantial differentiation of sulfurized olefin B from sulfurized olefin A.

Additional efficiency testing was run on a fluid formulated with the following components:

TABLE 6

| | Sample 9 |
|---|---|
| Additive Package | 1.2 |
| Methacrylate copolymer | 9 |
| Phosphorus amine salt-1 | 0.83 |
| Phosphorus amine salt-2 | 0.83 |
| Sulfurized olefin B | 4 |
| Zinc dialkyldithiophosphate | 0.27 |
| Oil of lubricating viscosity | Sum to 100 |
| KV at 100° C. | 5.83 |
| KV at 40° C. | 28.1 |

In this fluid a mixture of the two phosphorus amine salts is present and the levels of sulfurized olefin and zinc dialkyldithiphosphate have been modified.

TABLE 7

| | Power loss | | | Operating Temp (° C.) | | |
|---|---|---|---|---|---|---|
| | Cycle 1 | Cycle 3 | Cycle 10 | Cycle 1 | Cycle 3 | Cycle 10 |
| | | | Stage 7 | | | |
| Sample 9 | 1.11 | 0.92 | 0.87 | 89.8 | 75.2 | 71.7 |
| | | | Stage 11 | | | |
| Sample 9 | 1.29 | 1.12 | 1.06 | 101 | 87.4 | 83.8 |
| | | | Stage 16 | | | |
| Sample 9 | 1.78 | 1.71 | 1.65 | 121 | 111 | 108 |

The results for Sample 9 show comparable performance relative to Samples 4 and 8. The desired reduction in power loss and operating temperatures is still evident at increased levels of sulfurized olefin B and reduced levels of ZDDP.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as optionally modified by the word "about." It is to be understood that the upper and lower amount, range, and ratio limits set forth herein may be independently combined. Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the essential or basic and novel characteristics of the composition or method under consideration. The expression "consisting of" or "consisting essentially of," when applied to an element of a claim, is intended to restrict all species of the type represented by that element, notwithstanding the presence of "comprising" elsewhere in the claim.

An automotive or industrial gear oil comprising a) an oil of lubricating viscosity; b) 0.01 to 10 wt % of a sulfurized olefin comprising a mixture of sulfurized olefins of formula $R_1$—$S_x$—$R_2$ where $R_1$ and $R_2$ separately are derived from 2 to 6 carbon atom containing olefins and x is an integer of between 1 and 10, with the proviso that the sulfurized olefin will have a sulfur content of from about 10 to about 50 wt %, c) 0.1 to 2 wt % of a metal alkylthiophosphate.

The automotive or industrial gear oil of any previous sentence wherein the oil of lubricating viscosity comprises a group I oil.

The automotive or industrial gear oil of any previous sentence wherein the oil of lubricating viscosity comprises a group II oil.

The automotive or industrial gear oil of any previous sentence wherein the oil of lubricating viscosity comprises a group III oil.

The automotive or industrial gear oil of any previous sentence wherein the oil of lubricating viscosity comprises a group III+ oil.

The automotive or industrial gear oil of any previous sentence wherein the oil of lubricating viscosity comprises a group IV oil.

The automotive or industrial gear oil of any previous sentence wherein the oil of lubricating viscosity comprises a group V oil.

The automotive or industrial gear oil of any previous sentence wherein the oil of lubricating viscosity has a kinematic viscosity at 100° C. by ASTM D445 of 1.5 to 7.5 $mm^2/s$.

The automotive or industrial gear oil of any previous sentence wherein the oil of lubricating viscosity has a kinematic viscosity at 100° C. by ASTM D445 of 2 to 7 $mm^2/s$.

The automotive or industrial gear oil of any previous sentence wherein the oil of lubricating viscosity has a kinematic viscosity at 100° C. by ASTM D445 of 2.5 to 6.5 $mm^2/s$.

The automotive or industrial gear oil of any previous sentence wherein the oil of lubricating viscosity has a kinematic viscosity at 100° C. by ASTM D445 of 3 to 6 $mm^2/s$.

The automotive or industrial gear oil of any previous sentence wherein the oil of lubricating viscosity comprises a polyalphaolefin.

The automotive or industrial gear oil of any previous sentence, wherein $R_1$ and $R_2$ of the sulfurized olefin separately are derived from 3 to 5 carbon atom containing olefins.

The automotive or industrial gear oil of any previous sentence, wherein at least one of $R_1$ and $R_2$ of the sulfurized olefin separately are derived from butylene.

The automotive or industrial gear oil of any previous sentence, wherein at least one of $R_1$ and $R_2$ of the sulfurized olefin separately are derived from isobutylene.

The automotive or industrial gear oil of any previous sentence, wherein at least one of $R_1$ and $R_2$ of the sulfurized olefin separately are derived from amylene.

The automotive or industrial gear oil of any previous sentence, wherein at least one of $R_1$ and $R_2$ of the sulfurized olefin separately are derived from isoamylene.

The automotive or industrial gear oil of any previous sentence, wherein at least one of $R_1$ and $R_2$ of the sulfurized olefin separately are derived from diisobutylene.

The automotive or industrial gear oil of any previous sentence, wherein at least one of $R_1$ and $R_2$ of the sulfurized olefin separately are derived from mixtures of any of the foregoing olefins.

The automotive or industrial gear oil of any previous sentence, wherein the amounts of sulfur and hydrogen sulfide per mole of olefinic compound in the sulfurized olefin are, respectively, about 0.3-2.0 gram-atoms and about 0.1-1.5 moles.

The automotive or industrial gear oil of any previous sentence, wherein the amounts of sulfur and hydrogen sulfide per mole of olefinic compound in the sulfurized olefin are, respectively, about 0.5-1.5 gram-atoms and about 0.4-1.25 moles.

The automotive or industrial gear oil of any previous sentence, wherein the amounts of sulfur and hydrogen sulfide per mole of olefinic compound in the sulfurized olefin are, respectively, about 0.7-1.2 gram-atoms and about 0.4-0.8 mole.

The automotive or industrial gear oil of any previous sentence, wherein the sulfurized olefin is present at 0.1 to 8 wt %.

The automotive or industrial gear oil of any previous sentence, wherein the sulfurized olefin is present at 0.2 to 6 wt %.

The automotive or industrial gear oil of any previous sentence, wherein the sulfurized olefin is present at 0.5 to 5 wt %.

The automotive or industrial gear oil of any previous sentence, wherein the sulfurized olefin provides 0.5 to 3 wt % sulfur to the gear oil.

The automotive or industrial gear oil of any previous sentence, wherein the sulfurized olefin provides 0.75 to 2.75 wt % sulfur to the gear oil.

The automotive or industrial gear oil of any previous sentence wherein the sulfurized olefin provides 1 to 2.5 wt % sulfur to the gear oil.

The automotive or industrial gear oil of any previous sentence, further comprising 0.01 to 5.0 wt % of an amine alkyl(thio)phosphate compound.

The automotive or industrial gear oil of any previous sentence, further comprising 0.2 to 3 wt % of an amine alkyl(thio)phosphate compound.

The automotive or industrial gear oil of any previous sentence, further comprising 0.6 to 2 wt % of an amine alkyl(thio)phosphate compound.

The automotive or industrial gear oil of any previous sentence, further comprising 0.7 to 1.75 wt % of an amine alkyl(thio)phosphate compound.

The automotive or industrial gear oil of any previous sentence, further comprising 0.2 to 1.2 wt % of an amine alkyl(thio)phosphate compound.

The automotive or industrial gear oil of any previous sentence, further comprising 0.5 to 2.0 wt % of an amine alkyl(thio)phosphate compound.

The automotive or industrial gear oil of any previous sentence, further comprising 0.55 to 1.4 wt % of an amine alkyl(thio)phosphate compound.

The automotive or industrial gear oil of any previous sentence, further comprising 0.6 to 1.3 wt % of an amine alkyl(thio)phosphate compound.

The automotive or industrial gear oil of any previous sentence, further comprising 0.7 to 1.2 wt % of an amine alkyl(thio)phosphate compound.

The automotive or industrial gear oil of any previous sentence, further comprising 1 to 2 wt % of an amine alkyl(thio)phosphate compound.

The automotive or industrial gear oil of any previous sentence, further comprising 1.5 to 2 wt % of an amine alkyl(thio)phosphate compound.

The automotive or industrial gear oil of any previous sentence, further comprising 1.2 to 1.8 wt % of an amine alkyl(thio)phosphate compound.

The automotive or industrial gear oil of any previous sentence, further comprising 1.8 to 2.2 wt % of an amine alkyl(thio)phosphate compound.

The automotive or industrial gear oil of any previous sentence, further comprising amine alkyl(thio)phosphate compound suitable to provide phosphorus to the gear oil in an amount of 200 to 3000 ppm.

The automotive or industrial gear oil of any previous sentence, further comprising amine alkyl(thio)phosphate compound suitable to provide phosphorus to the gear oil in an amount of 400 to 2000 ppm.

The automotive or industrial gear oil of any previous sentence, further comprising amine alkyl(thio)phosphate compound suitable to provide phosphorus to the gear oil in an amount of 300 to 2000 ppm.

The automotive or industrial gear oil of any previous sentence, further comprising amine alkyl(thio)phosphate compound suitable to provide phosphorus to the gear oil in an amount of 600 to 1500 ppm.

The automotive or industrial gear oil of any previous sentence, further comprising amine alkyl(thio)phosphate compound suitable to provide phosphorus to the gear oil in an amount of 700 to 1100 ppm.

The automotive or industrial gear oil of any previous sentence, further comprising amine alkyl(thio)phosphate compound suitable to provide phosphorus to the gear oil in an amount of 900 to 1900 ppm.

The automotive or industrial gear oil of any previous sentence, further comprising amine alkyl(thio)phosphate compound suitable to provide phosphorus to the gear oil in an amount of 1100 to 1800 ppm.

The automotive or industrial gear oil of any previous sentence, further comprising amine alkyl(thio)phosphate compound suitable to provide phosphorus to the gear oil in an amount of 1200 to 1600 ppm.

The automotive or industrial gear oil of any previous sentence, further comprising amine alkyl(thio)phosphate compound suitable to provide phosphorus to the gear oil in an amount of 1500 to 2000 ppm.

The automotive or industrial gear oil of any previous sentence, wherein the amine alkyl(thio)phosphate comprises an amine phosphate.

The automotive or industrial gear oil of any previous sentence, where the amine phosphate comprises a substantially sulfur-free alkyl phosphate amine salt wherein at least about 30 mole percent of the phosphorus atoms are in an alkyl pyrophosphate salt structure and at least about 80 mole percent of the alkyl groups are secondary alkyl groups of about 3 to about 12 carbon atoms.

The automotive or industrial gear oil of any previous sentence, where the amine phosphate comprises a substantially sulfur-free alkyl phosphate amine salt wherein at least about 30 mole percent of the phosphorus atoms are in an alkyl pyrophosphate salt structure and at least about 25 mole percent of the alkyl groups in such a sulfur-free alkyl phosphate can be primary alkyl groups of about 3 to about 12 carbon atoms.

The automotive or industrial gear oil of any previous sentence wherein the amine comprises 2-ethylhexylamine.

The automotive or industrial gear oil of any previous sentence, wherein the amine alkyl(thio)phosphate comprises an amine alkylthiophosphate.

The automotive or industrial gear oil of any previous sentence, wherein the alkylthiophosphate of the amine alkylthiophosphate comprises a dialkyldithiophosphate.

The automotive or industrial gear oil of any previous sentence, wherein the amine comprises a $C_8$ to $C_{20}$ alkylamine.

The automotive or industrial gear oil of any previous sentence, wherein the metal alkylthiophosphate is represented by the formula

M

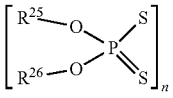

wherein $R^{25}$ and $R^{26}$ are independently hydrogen, hydrocarbyl groups or mixtures thereof, provided that at least one of $R^{25}$ and $R^{26}$ is a hydrocarbyl group.

The automotive or industrial gear oil of any previous sentence, wherein the metal alkylthiophosphate wherein $R^{25}$ and $R^{26}$ are independently hydrogen, an alkyl or cycloalkyl groups or mixtures thereof, provided that at least one of $R^{25}$ and $R^{26}$ is an alkyl or cycloalkyl group having 1 to 30 carbon atoms.

The automotive or industrial gear oil of any previous sentence, wherein the metal alkylthiophosphate wherein $R^{25}$ and $R^{26}$ are independently hydrogen, an alkyl or cycloalkyl groups or mixtures thereof, provided that at least one of $R^{25}$ and $R^{26}$ is an alkyl or cycloalkyl group having 2 to 20 carbon atoms.

The automotive or industrial gear oil of any previous sentence, wherein the metal alkylthiophosphate wherein $R^{25}$ and $R^{26}$ are independently hydrogen, an alkyl or cycloalkyl groups or mixtures thereof, provided that at least one of $R^{25}$ and $R^{26}$ is an alkyl or cycloalkyl group having 2 to 15 carbon atoms.

The automotive or industrial gear oil of any previous sentence, wherein the metal alkylthiophosphate wherein $R^{25}$ and $R^{26}$ are independently hydrogen, an alkyl or cycloalkyl groups or mixtures thereof, provided that at least one of $R^{25}$ and $R^{26}$ is a secondary alkyl group having 2 to 8 carbon atoms.

The automotive or industrial gear oil of any previous sentence, wherein the metal alkylthiophosphate wherein $R^{25}$ and $R^{26}$ are independently hydrogen, an alkyl or cycloalkyl groups or mixtures thereof, provided that at least one of $R^{25}$ and $R^{26}$ is a secondary alkyl group having 3 to 6 carbon atoms.

The automotive or industrial gear oil of any previous sentence, wherein the metal alkylthiophosphate comprises zinc dialkyldithiophosphate.

The automotive or industrial gear oil of any previous sentence, wherein the zinc dialkyldithiophosphate comprises, consists essentially of, or consists of a secondary zinc dialkyldithiophosphate.

The automotive or industrial gear oil of any previous sentence, wherein the alkyl of the zinc dialkyldithiophosphate comprises 3 to 6 carbon atoms.

The automotive or industrial gear oil of any previous sentence, wherein the alkyl of the zinc dialkyldithiophosphate comprises 3 carbon atoms.

The automotive or industrial gear oil of any previous sentence, wherein the alkyl of the zinc dialkyldithiophosphate comprises 6 carbon atoms.

The automotive or industrial gear oil of claim any previous sentence, wherein the zinc dialkyldithiophosphate provides from 0.02 to 0.2 wt % zinc to the automotive or industrial gear oil.

The automotive or industrial gear oil of claim any previous sentence, wherein the zinc dialkyldithiophosphate provides from 0.02 to 0.095 wt % zinc to the automotive or industrial gear oil.

The automotive or industrial gear oil of claim any previous sentence, wherein the zinc dialkyldithiophosphate provides from 0.025 to 0.085 wt % zinc to the automotive or industrial gear oil.

The automotive or industrial gear oil of claim any previous sentence, wherein the zinc dialkyldithiophosphate provides from 0.03 to 0.075 wt % zinc to the automotive or industrial gear oil.

The automotive or industrial gear oil of claim any previous sentence, wherein the zinc dialkyldithiophosphate is present from 0.15 to 0.8 wt %.

The automotive or industrial gear oil of claim any previous sentence, wherein the zinc dialkyldithiophosphate is present from 0.2 to 0.75 wt %.

The automotive or industrial gear oil of claim any previous sentence, wherein the zinc dialkyldithiophosphate is present from 0.25 to 0.70.

The automotive or industrial gear oil of claim any previous sentence, wherein the zinc dialkyldithiophosphate provides from 0.025 to 0.19 wt % zinc to the automotive or industrial gear oil.

The automotive or industrial gear oil of claim any previous sentence, wherein the zinc dialkyldithiophosphate provides from 0.03 to 0.18 wt % zinc to the automotive or industrial gear oil.

The automotive or industrial gear oil of claim any previous sentence, wherein the zinc dialkyldithiophosphate is present from 0.2 to 2 wt %.

The automotive or industrial gear oil of claim any previous sentence, wherein the zinc dialkyldithiophosphate is present from 0.25 to 1.9 wt %.

The automotive or industrial gear oil of claim any previous sentence, wherein the zinc dialkyldithiophosphate is present from 0.3 to 1.8 wt %.

The automotive or industrial gear oil of any previous sentence, further comprising 2,5-dimercapto-1,3,4-thiadiazole.

The automotive or industrial gear oil of any previous sentence, wherein the lubricant comprises a total sulfur level of about 0.75 to about 5 wt %.

The automotive or industrial gear oil of any previous sentence, wherein the lubricant comprises a total phosphorus level of about 0.01 to about 0.5 wt %.

A method of minimizing power losses in a driveline power transmitting device comprising providing to the driveline power transmitting device the automotive or industrial gear oil of any previous sentence, and operating the driveline power transmitting device.

The method of any previous sentence, wherein the driveline power transmitting device comprises an axle.

The method of any previous sentence, wherein the driveline power transmitting device comprises a bearing.

The method of any previous sentence, wherein the driveline power transmitting device comprises a gear.

A method of minimizing the operating temperatures of a gear comprising lubricating the gear with the automotive or industrial gear oil as claimed in any previous sentence directed to automotive or industrial gear oils above, and operating the gear.

A method of improving the operating efficiency of a gear comprising lubricating the gear with the automotive or industrial gear oil as claimed in any previous sentence directed to automotive or industrial gear oils above, and operating the gear.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

What is claimed is:

1. An automotive or industrial gear oil comprising a. an oil of lubricating viscosity;

b. 2.0 to 5 wt % of a sulfurized isobutylene, with the proviso that the sulfurized isobutylene will have a sulfur content of from about 10 to about 50 wt %, c. 0.25 to 2 wt % of a metal alkylthiophosphate, wherein the metal comprises zinc, and d. 0.5 to 5.0 wt % of an amine alkyl(thio)phosphate compound-, wherein the amount of sulfurized isobutylene present is suitable to provide sulfur to the automotive or industrial gear oil in an amount of 0.5 to 3 wt % sulfur.

2. The automotive or industrial gear oil of claim 1, wherein the amine alkyl(thio)phosphate comprises an amine phosphate.

3. The automotive or industrial gear oil of claim 2, where the amine phosphate comprises a substantially sulfur-free alkyl phosphate amine salt wherein at least about 30 mole percent of the phosphorus atoms are in an alkyl pyrophosphate salt structure and at least about 80 mole percent of the alkyl groups are secondary alkyl groups of about 3 to about 12 carbon atoms.

4. The automotive or industrial gear oil of claim 2, where the amine phosphate comprises a substantially sulfur-free alkyl phosphate amine salt wherein at least about 30 mole percent of the phosphorus atoms are in an alkyl pyrophosphate salt structure and at least about 25 mole percent of the alkyl groups in such a sulfur-free alkyl phosphate can be primary alkyl groups of about 3 to about 12 carbon atoms.

5. The automotive or industrial gear oil of claim 1 wherein the amine comprises 2-ethylhexylamine.

6. The automotive or industrial gear oil of claim 2 wherein the amine phosphate is present at from 0.5 to 2.0 weight percent.

7. The automotive or industrial gear oil of claim 1, wherein the amine alkyl(thio)phosphate comprises an amine alkylthiophosphate.

8. The automotive or industrial gear oil of claim 7, wherein the alkylthiophosphate of the amine alkylthiophosphate comprises a dialkyldithiophosphate.

9. The automotive or industrial gear oil of claim 7, wherein the amine comprises a $C_8$ to $C_{20}$ alkylamine.

10. The automotive or industrial gear oil of claim 7, wherein the amine alkylthiophosphate is present at from 0.5 to 2.0 weight percent.

11. The automotive or industrial gear oil of claim 1, wherein the metal alkylthiophosphate comprises zinc dialkyldithiophosphate.

12. The automotive or industrial gear oil of claim 11, wherein the zinc dialkyldithiophosphate comprises a secondary zinc dialkyldithiophosphate.

13. The automotive or industrial gear oil of claim 12, wherein the alkyl of the zinc dialkyldithiophosphate has 3 to 6 carbon atoms.

14. The automotive or industrial gear oil of claim 12, wherein the alkyl of the zinc dialkyldithiophosphate has 3 carbon atoms.

15. The automotive or industrial gear oil of claim 12, wherein the alkyl of the zinc dialkyldithiophosphate has 6 carbon atoms.

16. The automotive or industrial gear oil of claim 11, wherein the zinc dialkyldithiophosphate provides from 0.02 to 0.2 wt % zinc to the automotive or industrial gear oil.

17. The automotive or industrial gear oil of claim 1, further comprising 2,5-dimercapto-1,3,4-thiadiazole.

18. The automotive or industrial gear oil of claim 1, wherein the lubricant comprises a total sulfur level of about 0.75 to about 5 wt %.

19. The automotive or industrial gear oil of claim 1, wherein the lubricant comprises a total phosphorus level of about 0.01 to about 0.5 wt %.

20. A method of minimizing power losses in a driveline power transmitting device comprising providing to the driveline power transmitting device the automotive or industrial gear oil of claim 1, and operating the driveline power transmitting device.

21. The method of claim 20, wherein the driveline power transmitting device comprises an axle.

22. The method of claim 20, wherein the driveline power transmitting device comprises a bearing.

23. The method of claim 20, wherein the driveline power transmitting device comprises a gear.

24. A method of minimizing the operating temperatures of a gear comprising lubricating the gear with the automotive or industrial gear oil as claimed in claim 1, and operating the gear.

25. A method of improving the operating efficiency of a gear comprising lubricating the gear with the automotive or industrial gear oil as claimed in claim 1, and operating the gear.

* * * * *